US008132789B2

(12) United States Patent
Graebner

(10) Patent No.: US 8,132,789 B2
(45) Date of Patent: Mar. 13, 2012

(54) DRIVE DISK FOR HIGH PERFORMANCE FRICTION PAIRINGS

(76) Inventor: Peter Graebner, Dresden (DE)

( * ) Notice: Subject to any disclaimer, the term of this patent is extended or adjusted under 35 U.S.C. 154(b) by 2326 days.

(21) Appl. No.: 10/506,317

(22) PCT Filed: Mar. 7, 2003

(86) PCT No.: PCT/DE03/00808

§ 371 (c)(1),
(2), (4) Date: Aug. 30, 2004

(87) PCT Pub. No.: WO03/076324

PCT Pub. Date: Sep. 18, 2003

(65) Prior Publication Data

US 2011/0108785 A1 May 12, 2011

(30) Foreign Application Priority Data

Mar. 8, 2002 (DE) ..... 102 11 196

(51) Int. Cl.
*B66D 3/08* (2006.01)

(52) U.S. Cl. ..... 254/393; 254/374; 254/371; 254/372; 474/175; 474/176; 474/177; 474/192

(58) Field of Classification Search ..... 254/371, 254/372, 374, 393, 403, 404, 902; 474/175, 474/176, 177, 178, 190, 191, 192; D8/360
See application file for complete search history.

(56) References Cited

U.S. PATENT DOCUMENTS

| | | | | |
|---|---|---|---|---|
| 3,208,296 | A * | 9/1965 | Baermann | 474/142 |
| 3,437,074 | A * | 4/1969 | Hagopian et al. | 118/623 |
| 3,512,757 | A | 5/1970 | Ostrom | 254/135 |
| 3,610,583 | A * | 10/1971 | Ostrom | 254/266 |
| 3,643,921 | A * | 2/1972 | Puretic | 43/8 |
| 4,067,438 | A | 1/1978 | Spurr et al. | 198/805 |
| 6,027,103 | A * | 2/2000 | Painter | 254/332 |
| 6,386,324 | B1 * | 5/2002 | Baranda et al. | 187/254 |
| 6,401,871 | B2 * | 6/2002 | Baranda et al. | 187/254 |
| 6,641,117 | B2 * | 11/2003 | Heun et al. | 254/371 |
| 6,857,187 | B2 * | 2/2005 | Epstein | 29/894 |
| 7,461,721 | B2 * | 12/2008 | Aulanko et al. | 187/254 |

FOREIGN PATENT DOCUMENTS

| | | |
|---|---|---|
| DE | 346727 | 1/1922 |
| DE | 1120702 | 12/1961 |
| DE | 1202587 | 10/1965 |
| DE | 33 12 522 A1 | 10/1983 |
| DE | 36 26 045 A1 | 2/1988 |
| DE | 39 23 192 A1 | 1/1991 |
| JP | 06/117520 | 4/1994 |
| JP | 08/059148 | 3/1996 |

* cited by examiner

*Primary Examiner* — Emmanu M Marcelo
(74) *Attorney, Agent, or Firm* — Norris, McLaughlin & Marcus, P.A.

(57) ABSTRACT

A drive disk with rim segments which are located at a distance from each other and are embodied in the form of segments of the groove track which are made from the same or different material and high-powered magnets are introduced in between the grooves in the drive disk rim and the cable along the peripheral line of the drive disk rim. Foamed steel or fiber composite ceramics or similar, respectively with increased friction values, are used as materials for the rim segments.

9 Claims, 3 Drawing Sheets

DRIVE DISK FOR HIGH PERFORMANCE FRICTION PAIRINGS

BACKGROUND OF THE INVENTION

1. Field of the Invention

The invention relates to a novel construction of drive disks for cable drives and the like, in particular hoists, for improved power transmission.

Main fields of application of the invention are hoist drive disks for multiple cable operation, drive disks for selectively operable in a single cable mode under lifting loads, such as, for instance, cable driven lifting platforms (for instance façade maintenance devices, building scaffolds);

cable driven vehicles for stationary cable structures (suspension brides, cable suspended roofs, cable cranes, cable cars);

selective cable car drives;

selective chair lift drive;

endless lifting winches for any applications.

A further field of application of the invention are mechanical endless conveyors operating on the traction principle and which satisfy the preconditions of magnetic materials.

The state of the art relating to lift drive disks is characterized by arrangements, the technical realizations of which is based upon Coulomb's law as applied to friction utilizing a homogeneous groove.

2. The Prior Art

Arrangements are known from the claimed field of application of mining shaft conveyors which, while they increase the driving capacity of the cable-drive disk system by groove inserts of different but soft materials, are unsuited for operating in hoists. About eight decades ago, consideration was given in the mining industry to improving the power transmission by the use of electromagnets.

In this connection, the relevant (German) patent document DE 34 67 27 C discloses the groove of the drive disk wherein the load bearing member is received, to consist of segments structured as pole pieces of an array of electromagnets of alternating polarity the flux path of which between adjacent poles extends through the load bearing member.

In connection with line hauling systems of cable laying ships U.S. Pat. No. 3,512,757 discloses the application of magnets in the cable sheaves of winches. In those cases, conventional magnets used which require significant space and added technical complexity and which, therefor, can be used only in single cable operations of large dimensions.

German patent specification DE 33 12 522 A1 discloses a drive disk for particular use in mining, in which in the grooves of the disk rim there is inserted a lining structured as flexible elastic ring having lining elements affixed thereto.

In German patent specification DE 36 26 045 A1, too, there is described a drive disk for mining applications in which along the circular groove of the rim there is arranged a freely movable coating. The coating consists of two layers, i.e. an upper layer of a strip of elastic material and a layer of subdivided into sections connected to each other and in direct contact with the rim. The mentioned sections in this case consist of a (plain) bearing material.

The subject of German patent specification DE 39 23 192 A1 is a drive disk especially for single cable conveyance in mining provided with a drive disk rim in the groove of which coating inserts are arranged at random with a gap between them. At both their ends, the V-shaped coating inserts are provided, in the direction of movement of the drive disk, with penetrating bores through which a pulling member is fed which is circumscribing the groove.

German patent DE 1,202,587 B describes a reinforcement for use in cable and drive disks for mining applications in which lining materials of a light metal, a hard polymer or the like is affixed to the base body of the of the drive disks and the coefficient of friction and wear resistance of the lining are increased.

German patent DE 1,120,702 B describes a specific lining material for drive disks for shaft conveyors in the mining industry which consists of a specific cast alloy G Al Si. The lining blocks are alternatingly installed on the circumference of the drive disk with lining blocks of thermoplastic polymers or thermoplastic-like polymers.

With prior art inserts in the grooves of drive disk rims known It has been possible to improve wear and frictional behavior of drive disks used in the mining industry. The requisite structural arrangements are complex. In the context of large ratios between the diameter of drive disks and the diameter of cables—greater than about 40—corresponding applications are conceivable in hoist structures as well. The trend toward light structures will lead to ratios of diameters for hoists into the range of 20 to 30. Increased pressure strains and searing stresses—resulting from uneven cable forces—cause the hitherto known insert materials to fail. In single cable operations, the utilization of force fields to increase the driving capacity is known from the mining field and from hauling winches. However, the arrangements are structurally complex, require large space and increase the systems technology.

OBJECTS OF THE INVENTION

It is, therefore, an object of the invention substantially to increase the forces transmitted from hoist drive disks to the cable to be driven, particularly under extreme stress conditions of the kind occurring at large cable to force ratios and/or small ratios of drive disk to cable. The object includes an analogous increase of the transmission forces in such pairings as drive disk and steel conveyor cable and drive drum and chain, with a simplified structure of related system components.

SUMMARY OF THE INVENTION

In the accomplishment of these and other objects the invention provides, in a currently preferred embodiment, for a drive disk provided with at least one peripheral groove for guiding a cable and having disposed therein, at regularly spaced intervals, alternating rim segments and inlays of high-energy permanent magnets, the disk being provided with a rim made of foamed steel, fiber composite ceramics or similar friction improving materials.

Other objects will in part be obvious and will in part appear hereinafter.

As provided by the invention, inlays structured as high-energy magnets from the group of rare earths having energy products of 385 kJ/m$^3$ are inserted spaced from each along the circumference of groove(s) present in the rim of drive disks. The inserts are sunk into recesses in the groove track in a manner conforming to the surface. This arrangement may be applied to a plurality of adjacent grooves. The arrangement may be supplemented by rim segments between the inlays.

The material used for the above-mentioned drive disk rim or for the rim segments may be the classical drive disk materials such as gray cast iron and the like or, instead, novel compound materials which increase the friction coefficient such as foamed steel materials and fiber composite ceramics which satisfy the requirements regarding compression strength and wear resistance when used in hoist drive disks and similar applications. If rim segments are selected foamed steel materials and/or fiber composite ceramics are the materials preferable used.

This special approach makes it possible to increase Coulomb's friction force since, using fiber composite ceramics, for instance, the values of friction in an idle state reach 0.4 and, in addition, the normal force from the cable forces is superimposed by a normal force generated by the magnetic forces as a result of the high-energy magnets inserted as inlays at regular intervals. Hence, $$F_{uMgn}=\mu_{Mgn}$$

wherein $F_{uMgn}$ is the tangential resistance force in the area of the magnet effective at the circumference of the drive disk against cable expansion or slippage;

$F_{Mgn}$ is the magnetic gripping force;

$\mu_{Mgn}$ the value of friction in the area of the magnet.

The above-mention high-energy magnets are being used which in respect of gripping forces, hardness, shape, wear resistance are to be fabricated as permanent magnets suitable for the individual application. Their arrangement within a given groove track is such that the axis of the magnet and, hence, of the magnetic force, is directed radially.

The inlay segments and, optionally, additional rim segments are distributed over the 360° circumference of the rim of the drive disk with the segments being uniformly spaced from each other by a circumferential angle $\alpha$. The size of angle $\alpha$ is a function of the desired driving capacity of the pairing drive disk-cable or drive disk-belt.

This technical approach makes it possible to provide frictional values in round grooves which correspond to those of V-belts at a defined cross-sectional angle and attainable state of wear, but which, in contrast to the V-groove or an undercut round groove ensure a significantly reduced wear of the groove (lower compression) and long cable life relative to a given design. To satisfy extreme demands, of the power transmission, for instance, the teachings of the invention may also be applied to other shapes of grooves, in particular round undercut grooves.

Optimization of the design of the drive disk relative to

- the magnetic gripping force, the geometric shape of the high-energy permanent magnets, the definition of further physical parameters, the arrangement of the magnets on the one hand and/or
- structuring of the rim of the drive disk of gray cast iron, polymers and the like, foamed steel or compound ceramics on the other hand is selectively carried out in accordance with a given technical purpose.

The arrangement requires a modified approach to Eytelwein's equation $$F1/F2*\phi(p)\leqq e^{\mu\beta}$$

where

F1, F2: cable forces;

$\phi(p)$: delay factor;

e: base of natural logarithm;

$\mu$: apparent value of friction;

$\beta$: geometric arc of conduct.

If the drive disk described in its structure is widened in its axial direction, the result will be a drive drum for mechanical endless conveyors, the basic structure of which is structured like a drive disk wherein the arrangement of rim segments (5) and inlays (6) have been widened in the axial direction, i.e. over the width of the drive drum.

The advantages connected with the patent are multifarious, i.e., among others:

- increase of Coulomb's friction force by raising $\mu^{System}$ as a result of using fiber composite ceramics or foamed steel materials and the like;
- superposing Coulomb's friction force with a magnetic friction force-generated by high-energy magnets from the group of rare earths;
- selective design of the drive disk for low wear transmission of large circumferential forces of transmission of very large circumferential forces for special applications.

A significant increase of the drive capacity of round grooves in particular was attained.

The transmission of force is significantly improved by the measures mentioned, the secondary consequences connected therewith are:

- savings in the mass of the cable drive by an enlarged and technically transferrable F1/F2 ratio, possibility of extremely light construction in hoist technology;
- possible reduction of the required diameter of the drive disk;
- reduction of the cable diameters as a result of reduced strain or load in view of the fact that wear as a result of expansion or slippage at the drive disk are substantially reduced;
- because of the smaller diameter of the drive disk, smaller drives by increased rotations of the drive disk;
- reduction of the required energy, always connected with associated economic advantages.

DESCRIPTION OF THE SEVERAL DRAWINGS

The novel features which are considered to be characteristic of the invention are set forth with particularity in the appended claims. The invention itself, however, in respect of its structure, construction and lay-out as well as manufacturing techniques, together with other objects and advantages thereof, will be best understood from the following description of preferred embodiments when read in connection with the appended drawings, in which:

DETAILED DESCRIPTION OF PREFERRED EMBODIMENTS

Figure 1B:
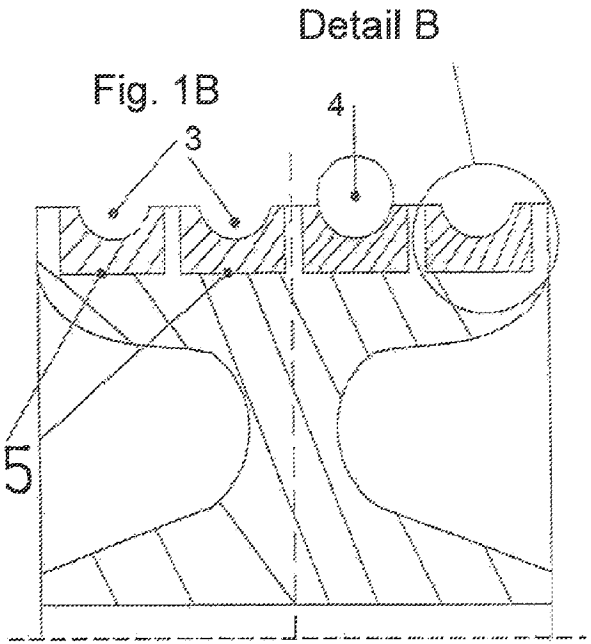
FIG. 1B is a cross-sectional view along line A-A of FIG. 1A.
Figure 1A:
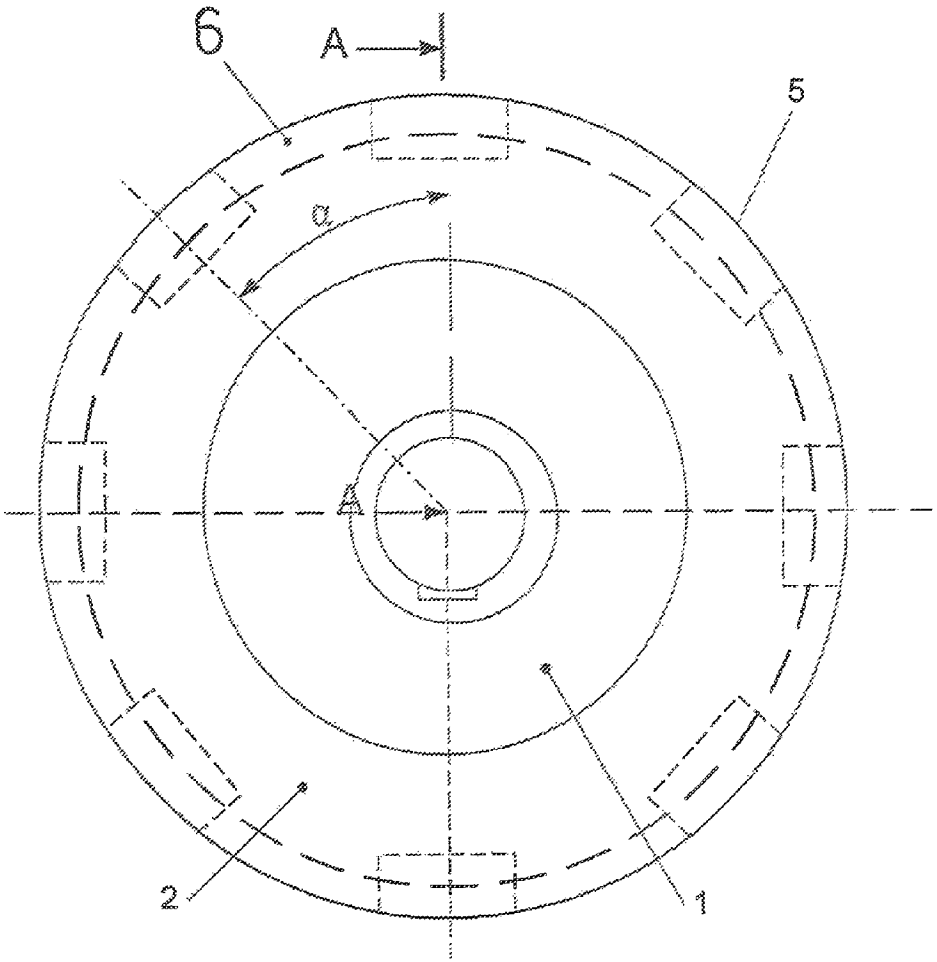
FIG. 1A depicts the structure of the drive disk rim with rim segments of fiber composite ceramics arrayed between the inlays of high-energy magnets.

FIG. 1 depicts an exemplary array of rim segments 5 and, optionally, inlays 6 over the 360° circumference of the drive disk rim 2. The rim segments 5 are arrayed, spaced from each other by circumferential angle α (alpha), in every groove track 3 (see section A-A). Alternatively, this may in the axial direction be formed of one piece inserted into all groove track 3.

To achieve a predetermined drive capacity of the drive disk, other arrays, constructions and distribution densities of inlay segments 6 (high-energy magnets) over the circumference of the drive disk rim 2 may additionally or exclusively be selected.

Figure 2A:
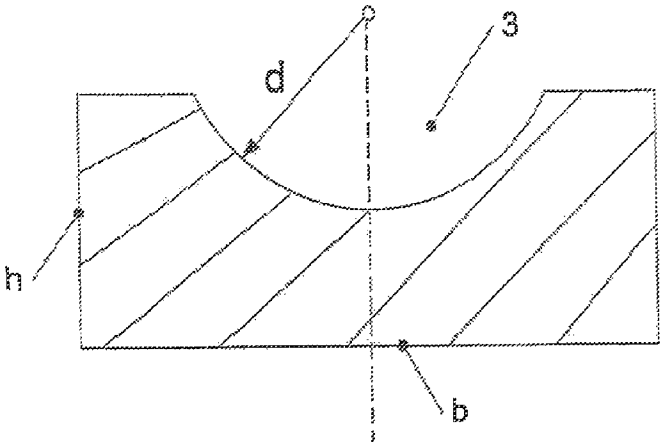
FIG. 2A shows a groove segment made of a material different from the remained of the groove rim. In a different construction, this material may be sued for the entire rim in which the bores for receiving the high-energy magnets would be formed.
Figure 2B:
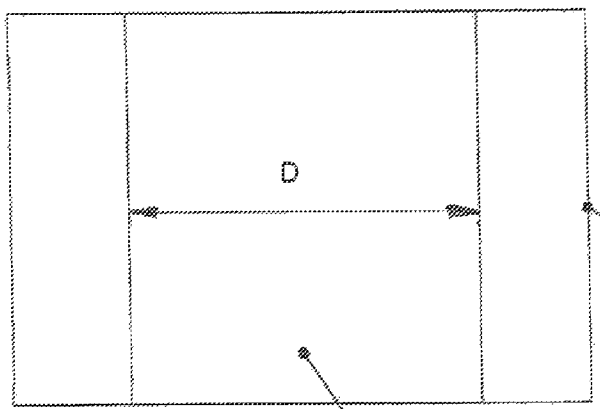
FIG. 2B shows a top view of the groove segment of FIG. 2A.

FIG. 2A shows a detail B of the exemplary geometry of a rim segment 5 from FIG. 1B. The shape of the groove 3 is defined by its radius of curvature, d corresponding to the diameter of the cable 4. The dimensions of the width b and height h of the rim segment 5 correspond approximately to twice the diameter D of the groove, i.e. b=h−2D. The length 1 of a rim segment 5 (as depicted in FIG. 2B) is at least thrice the diameter D' of the cable, i.e., 1−3D'.

Figure 3B:
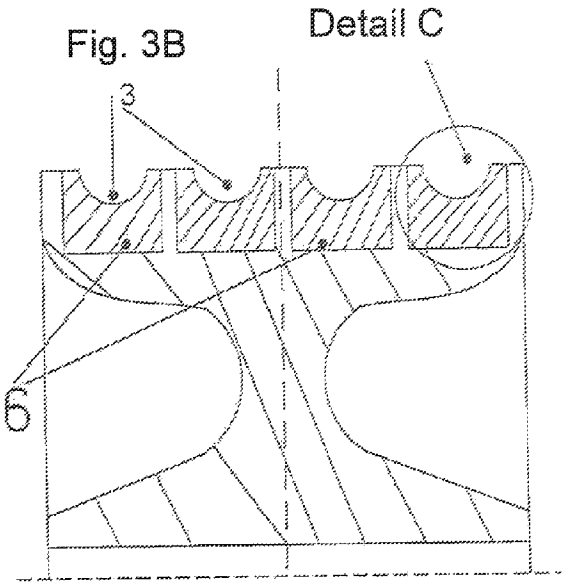
FIG. 3B is a cross-sectional view along line A-A of FIG. 3A.
Figure 3D:
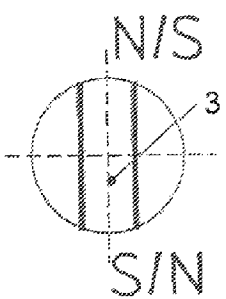
FIG. 3D is a top view of detail C of FIG. 3C.
Figure 3C:
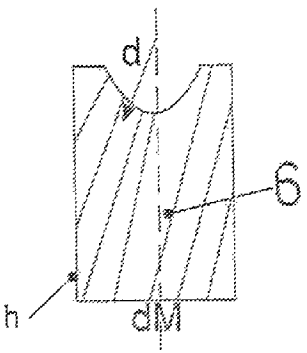
FIG. 3C is an enlarged view of detail C of FIG. 3B.
Figure 3A:
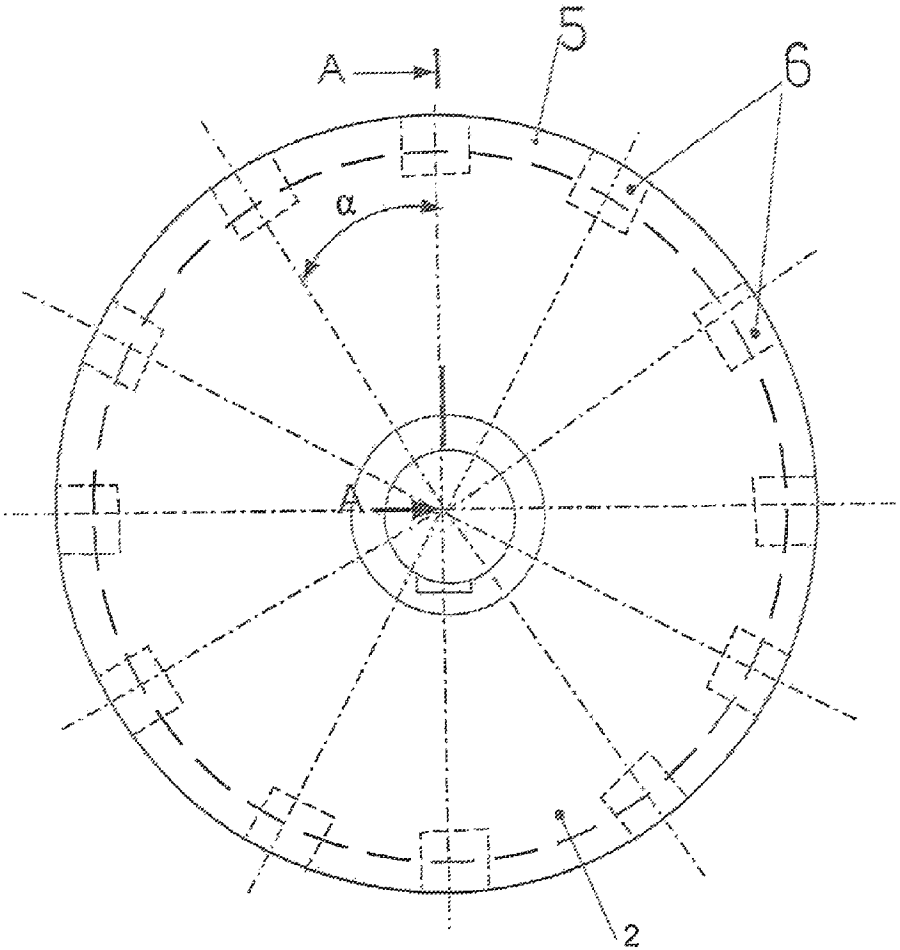
FIG. 3A depicts the design of a drive disk for high efficiency friction pairings in which high-energy magnets are inserted as inlay segments into groove tracks of the drive disk rim.

FIG. 3A depicts the design of a drive disk for high efficiency friction pairings with high-energy magnets 6 inserted as inlay segments analogously to FIG. 1. The high-energy magnets 6 are of cylindrical shape (see detail C, in FIGS. 3B; 3C; 3D) and are of the following dimensions for height h and diameter $d_M$ of the magnets: h−25−35 mm; $d_M$-20−32 mm. The polarity is indicated as well. At present, such magnets achieve gripping forces of 42-700 N.

The material of the base body 1 and the drive disk rim 2 used in both embodiments is traditional grey cast iron. The rim may, if high-grade materials such as foamed steel, fiber composite ceramics and the like are being used, be fabricated separately and connected to the base body in a suitable manner.

What is claimed is:

1. A drive disk for high-efficiency friction pairings comprising:

a drive disk base body (1);

a drive disk rim (2) having at least one groove track (3) defined in its outer surface;

spaced rim segments (5) are inserted into the drive disk rim (2) as segments of different materials of the groove track and alternating with the rim segments (5) high-energy magnets are inserted as inlays (6), the materials for the rim segments (5) being foamed steel materials and/or fiber composite ceramics.

2. The drive disk of claim 1, wherein the groove track (3) in the drive disk rim or in the rim segments (5) are structured as round grooves or undercut round grooves.

3. The drive disk of claim 1, wherein the rim segments (5) inserted into the groove track (3) are structured as circular segments inserted into fitting positive recesses of the drive disk rim (2) in conformity therewith.

4. The drive disk of claim 1, wherein the arrangement of the high-energy magnets as inlays (6) in the groove track (3) is such that an axis of a magnetic field and, thus, of a magnetic force, is directed radially.

5. The drive disk of claim 1, wherein a plurality of groove tracks (3) with rim segments (5) and/or inlays (6) are arranged in an axial direction of the drive disk (1).

6. The drive disk of claim 1, wherein the base body of the drive disk (1) is made of grey cast iron or cast steel or steel or composite materials or polymeric material; and the drive disk rim (2) of corresponding size made of grey cast iron or alloyed cast iron or cast steel or alloyed cast steel or foamed steel or ceramics or polymeric material is mounted on the drive disk base body in an expansion proof manner with recesses spaced from each other for receiving the high-energy magnets (6).

7. The drive disk of claim 1, wherein the drive disk is used for mechanical endless conveyers with the rim segments (5) and inlays (6) may be arranged in axial direction over a width of the drive disk.

8. The drive disk of claim 1, wherein the drive disk is used for a hoist in a wire cable drive.

9. A drive disk for high-efficiency friction pairings comprising:

a drive disk base body (1);

a drive disk rim (2) having at least one groove track (3) defined in its outer surface:

spaced rim segments (5) are inserted into the drive disk rim (2) as segments of different materials of the groove track and alternating with the rim segments (5) high-energy magnets are inserted as inlays (6), the materials for the rim segments (5) being foamed steel materials and/or fiber composite ceramics;

wherein the rim segments (5) and the inlays (6) are arranged alternatively and displaced from each other by peripheral angle α along a 360° periphery of the groove track (3).

* * * * *